US006774874B2

(12) United States Patent
Naka et al.

(10) Patent No.: US 6,774,874 B2
(45) Date of Patent: Aug. 10, 2004

(54) DISPLAY APPARATUS FOR DISPLAYING AN IMAGE AND AN IMAGE DISPLAYING METHOD

(75) Inventors: Kazutaka Naka, Tokyo (JP); Masanori Takeuchi, Kawasaki (JP)

(73) Assignee: Hitachi, Ltd. (JP)

( * ) Notice: Subject to any disclaimer, the term of this patent is extended or adjusted under 35 U.S.C. 154(b) by 254 days.

(21) Appl. No.: 09/930,837

(22) Filed: Aug. 15, 2001

(65) Prior Publication Data

US 2002/0075287 A1 Jun. 20, 2002

(30) Foreign Application Priority Data

Dec. 14, 2000 (JP) ..... 2000-380289

(51) Int. Cl.[7] ..... G09G 3/28
(52) U.S. Cl. ..... 345/60; 345/690
(58) Field of Search ..... 345/60, 63, 61, 345/77, 89, 690, 691, 692; 315/169.1, 169.3, 169.2, 160

(56) References Cited

U.S. PATENT DOCUMENTS 5,856,823 A * 1/1999 Kimoto et al. ..... 345/600
5,874,933 A 2/1999 Hirai et al.
6,144,364 A * 11/2000 Otobe et al. ..... 345/691
6,407,506 B1 * 6/2002 Naka et al. ..... 315/169.1

FOREIGN PATENT DOCUMENTS

EP 0874349 A 10/1998
EP 0890941 A 1/1999

* cited by examiner

*Primary Examiner*—Chanh Nguyen
(74) *Attorney, Agent, or Firm*—Townsend and Townsend and Crew LLP

(57) ABSTRACT

A group of high order subfields and a group of low order subfields are provided, at least one independent control subfield is provided in the group of low order subfields and in other low order subfields, two lines are simultaneously addressed using the same data. Hereby, a display and an image displaying method wherein an address control period is reduced, using this surplus time, the luminance is enhanced, multiple gradations are provided or a pseudo contour interference is reduced, the resolution information of a displayed image is limited and synthetic image quality is enhanced are provided.

19 Claims, 13 Drawing Sheets

FIG. 13

| EQ | RU | Q1 [$\alpha$] | Q2 [$\alpha$] | Q1,Q2 [$\alpha$-1:0] |
|---|---|---|---|---|
| 0 | 0 | 1 | 0 | FOR LOW ORDER BITS PROCESSING, REFER TO FIG.15 |
| 0 | 1 | 0 | 1 | |
| 1 | 0 | O1 [$\alpha$] | O2 [$\alpha$] | O1,O2 [$\alpha$-1:0] |
| 1 | 1 | DISABLED | | |

FIG. 15

| O [ $\alpha$ ] | O [ $\alpha$ -1] | Q [ $\alpha$ -1] | Q [ $\alpha$ -2:0] |
|---|---|---|---|
| 1 | 0 | 1 | O [ $\alpha$ -2:0] |
| 0 | 1 | 0 | O [ $\alpha$ -2:0] |
| 0 | 0 | 0 | 0, 0 ··· 0 |
| 1 | 1 | 1 | 1, 1 ··· 1 |

DISPLAY APPARATUS FOR DISPLAYING AN IMAGE AND AN IMAGE DISPLAYING METHOD

CROSS REFERENCE TO RELATED APPLICATION

This application is related to claims priority from Japanese Application No. 2000-380289, filed Dec. 14, 2000.

BACKGROUND OF THE INVENTION

1. Field of the Invention

The present invention relates to a display and an image displaying method, particularly relates to a display and an image displaying method wherein gradation representation is made in a subfield mode and data every line is sequentially output and displayed in each subfield.

2. Description of the Related Art

Recently, in place of a cathode ray tube (CRT) display which has been used heretofore, a flat panel display using liquid crystal and plasma which is thin and light, which has little distortion of the screen and is hardly influenced by earth magnetism is used. Particularly, a plasma display which has a large angle of visibility because of a spontaneous emission type and the large-sized panel of which can be manufactured relatively easily attracts attention as a display of a picture signal.

Generally, for a plasma display, as halftone display between emission and non-radiation is difficult, a method called a subfield mode is used to display a halftone. In the subfield mode, the gradation of the luminance of one field is represented by dividing the time length of one field into plural subfields, allocating the proper weight of emission to each subfield and controlling the emission and non-radiation of each subfield.

SUMMARY OF THE INVENTION

Currently, in an address-sustained separation method which is a mainstream out of methods of a plasma display, one subfield includes a control pulse for respectively controlling a reset period for initializing a state of a discharge cell, an address control period for controlling the lighting and unlighting of the discharge cell and a sustention period for determining the amount of emission. These control pulses are not to be shorter than predetermined time length to realize the stable control of emission.

In the address control period, as addressing is performed based upon data for controlling lighting and unlighting every line, more time is required because the number of lines is increased for a high-resolution panel. Therefore, there is a problem that the number of subfields into which one field period can be divided is limited and enough luminance is not acquired.

For example, to realize a high-definition panel the vertical resolution of which is 1000 lines using a display panel requiring 2 $\mu$s. per line for address control processing, an address control period of 2 $\mu$s. (=2 $\mu$s.×1000 lines) per subfield is required. Generally, approximately 256 gradations (8 bits) are required to display a picture signal without deteriorating it, however, to divide one field period of approximately 16.6 ms. into eight subfields, time is hardly allocated to the sustention period. There is a problem that as most of one field period is allocated to an address control period every subfield as described above, the sustention period which contributes to panel emission cannot be secured enough.

In case the number of subfields is limited, for example in case the number of subfields is limited to 6 subfields (64 gradations), enough gradation cannot be represented and it is difficult to realize a high quality display.

Further, for a problem proper to gradation display according to the subfield mode, there is pseudo contour interference which deteriorates the quality of a dynamic image. To reduce this pseudo contour interference, a method of increasing the number of subfields and controlling the distribution of emission and the centroid of emission respectively in one field is used. As the more the number of subfields is, the more controllable emission patterns are in case the number of representable gradations is the same, the effect of reducing pseudo contour interference increases. Therefore, there is a problem that in case enough subfields are not acquired, the quality of a dynamic image when it is displayed is remarkably deteriorated by this pseudo contour interference.

In a conventional type display, it is basically regarded as important that an input signal is faithfully displayed and a method of acquiring high quality in consideration of the characteristic of a human visual sense such as dither for compensating the shortage of gradations, error diffusion processing and the control of average luminance is also partly used, however, the control of the amplitude of a signal is main.

For well-known technique, in JP-A No. H11-24628, "GRADATION DISPLAY METHOD OF PLASMA DISPLAY PANEL", a method of reducing address control time by interlaced scanning in a subfield equivalent to a low order bit and a method of simultaneously selecting two scanning electrodes and writing in place of interlaced scanning are disclosed, however, a concrete method of generating a signal is not disclosed.

Each line of a picture signal is data sampled in a vertical direction of one screen and when sampled data is thinned out by interlaced scanning, vertical resolution is required to be reduced by half beforehand to reduce folding interference. Hereby, vertical resolution is reduced by half and an image is displayed in low resolution.

It is known that in case sampled data is thinned out without reducing vertical resolution by half beforehand, a high frequency component of a signal is converted to a low frequency by folding interference and the image quality is greatly deteriorated.

The object of the invention is to provide a display and an image displaying method wherein the amount of the information of the resolution of an displayed image is limited if necessary positively utilizing the characteristic of a human visual sense and the statistical property of a picture signal and the synthetic image quality is enhanced.

Another object of the invention is to provide a high-resolution display and an image displaying method wherein subfields of the enough number are secured by improving total address control periods which account for the time of a field and gradation representation, a measure against pseudo contour interference and further, the realization of high-luminance display are implemented.

The invention adopts the following methods to solve the above-mentioned problems.

Address control periods are reduced by simultaneously performing addressing for two lines based upon the same data in a predetermined subfield and the time is allocated to the improvement of image quality in luminance, gradation and a pseudo contour.

Addressing every line is performed in high order subfields including the most significant subfield as in prior art and simultaneous addressing for two lines based upon the same data is performed in a group of low order subfields to which relatively small weight of emission is allocated.

Further, a subfield in which addressing independent every line is performed as in prior art is provided to a part of the group of low order subfields.

Display resolution information in units of subfield is limited by dividing an input picture signal into vertical frequency components and selectively synthesizing them again.

Further, in case a subfield in which addressing is simultaneously performed for two lines based upon the same data exists, the average value for two lines of a display signal is possibly equalized to the average value for two lines of an input signal.

BRIEF DESCRIPTION OF THE DRAWINGS

FIG. 13 shows the logical operation of the independent bit adding circuit;

FIG. 15 shows the logical operation of the independent bit adding circuit.

DETAILED DESCRIPTION OF PREFERRED EMBODIMENTS

Figure 1:
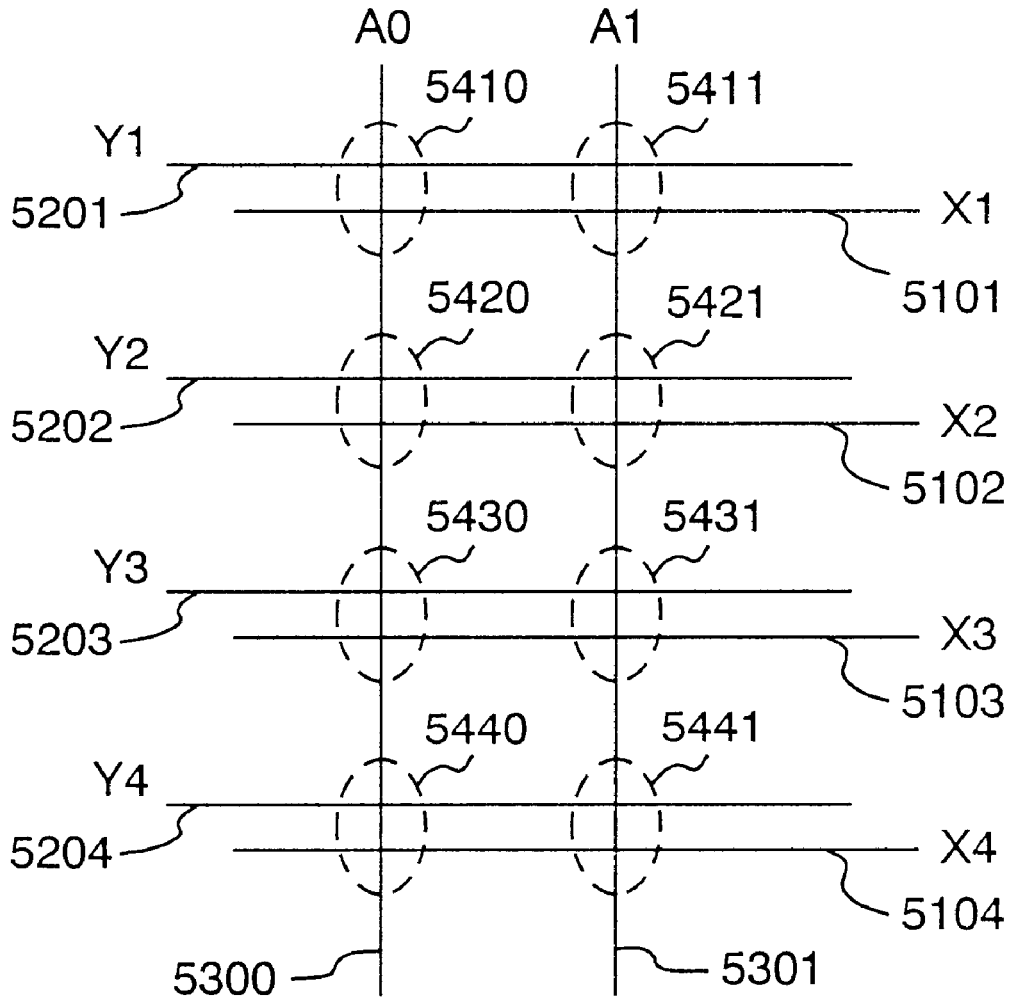
FIG. 1 is a schematic drawing showing the layout of discharge cells and electrodes of an AC3 electrode-type plasma display.

Referring to the drawings, embodiments of the invention will be described below.

FIG. 1 is a schematic drawing showing the layout of discharge cells and electrodes of an Ac3 electrode-type plasma display.

As shown in FIG. 1, reference numbers 5101, 5102, 5103 and 5104 denote an X sustaining electrode, 5201, 5202, 5203 and 5204 denote a Y sustaining electrode and 5300 and 5301 denote an address electrode. Each address electrode 5300, 5301 is formed on a rear plate, the X sustaining electrodes 5101 to 5104 and the Y sustaining electrodes 5201 to 5204 are formed on a front plate, and a picture element is formed in the intersection of a pair of the X sustaining electrode and the Y sustaining electrode and the address electrode. Picture elements 5410, 5411, 5620, 5421, 5430, 5431, 5440 and 5441 are formed by discharge between these electrodes on a panel as shown in FIG. 1.

Control over lighting and unlighting every line will be described below using voltage applied to the Y sustaining electrodes 5201 to 5204 and the address electrodes 5300 and 5301 in an address control period according to prior art shown in FIG. 2 for comparing with the invention.

Figure 2:
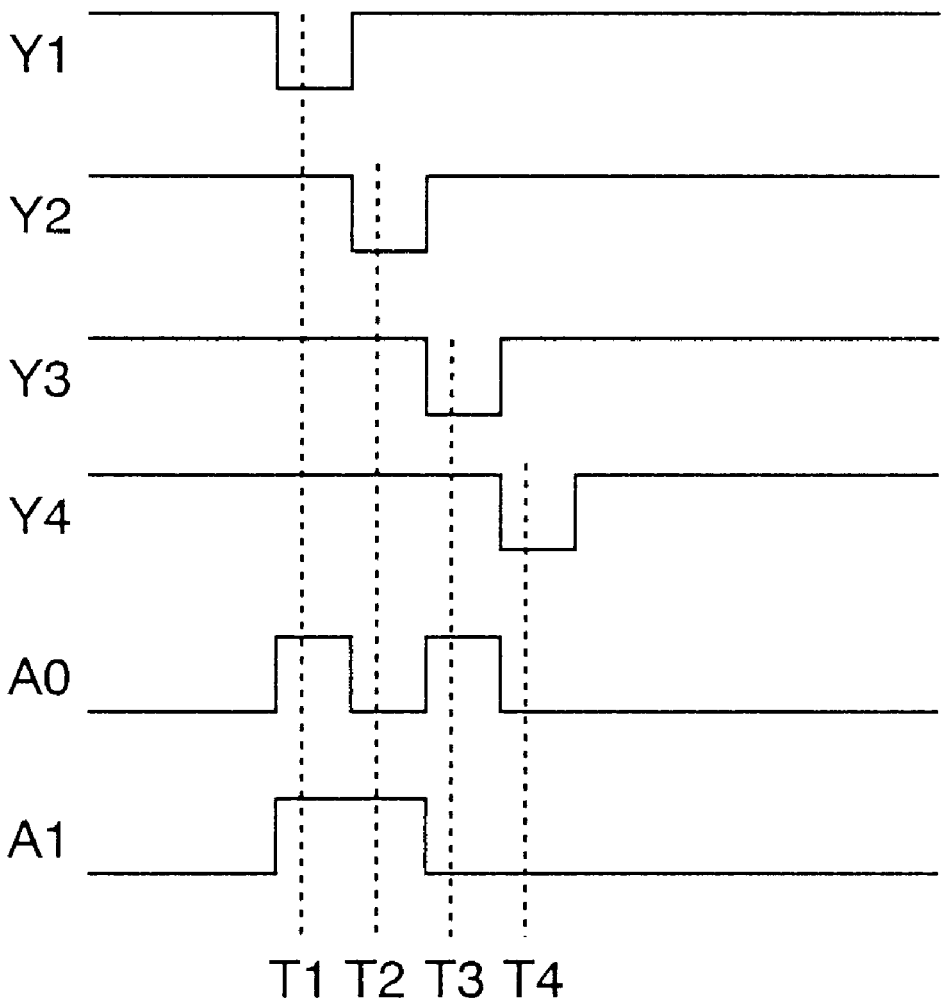
FIG. 2 shows waveforms of voltage applied to a Y sustaining electrode and an address electrode in an address control period.

FIG. 2 shows the waveforms of voltage applied to the Y sustaining electrode and the address electrode in the address control period. As shown in FIG. 2, a scan pulse is applied in the order of the Y1 sustaining electrode 5201, the Y2 sustaining electrode 5202, the Y3 sustaining electrode 5203 and the Y4 sustaining electrode 5204 and an address pulse for controlling lighting and unlighting every line is applied to the A0 address electrode 5300 and the A1 address electrode 5301.

As a scan pulse is applied to the Y1 sustaining electrode 5201 at time T1, the lighting and unlighting of the picture elements 5410 and 5411 on a first line are controlled. In this example, as address voltage is applied to both the A0 address electrode 5300 and the A1 address electrode 5301, address discharge is caused between the A0 address electrode 5300 and the Y1 sustaining electrode 5201 and between the A1 address electrode 5301 and the Y1 sustaining electrode 5201 and a wall charge is generated so that emission is implemented in the succeeding sustention period. Hereinafter, addressing in which the lighting and unlighting of the picture elements 5420 and 5421 on a second line, the picture elements 5430 and 5431 on a third line and the picture elements 5440 and 5441 on a fourth line is controlled is respectively performed at time T2, T3 and T4. A wall charge in a cell is generated by such addressing every line if necessary and emission is controlled in the succeeding sustention period.

Field configuration that one field is constituted of five subfields (SF1, SF2, SF3, SF4, SF5) according to the prior art shown in FIG. 2 for comparing with the invention will be described below.

Figure 3:
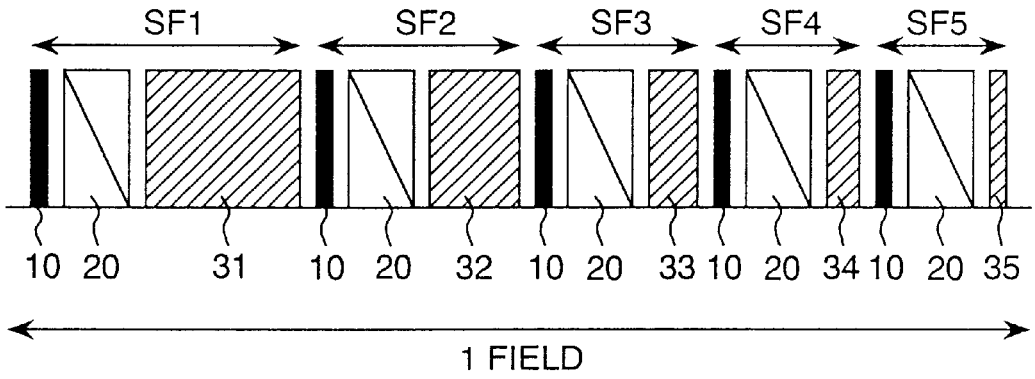
FIG. 3 is a schematic drawing showing field configuration in case one field is constituted of five subfields.

FIG. 3 is a schematic drawing showing field configuration in case one field is constituted of five subfields. As shown in FIG. 3, a reference number 10 denotes a rest period for initializing a state of a discharge cell in each subfield, 20 denotes an address control period for controlling the lighting and unlighting of each picture element in each subfield and 31, 32, 33, 34 and 35 denote a sustention period in which the amount of emission in respective subfields is determined. In these sustention periods 31 to 35, emission according to the number of sustaining pulses is made in a discharge cell in which a wall charge is generated in the address control period 20 so that emission is possible. In a subfield mode, to realize gradation representation, the weight of emission corresponding to each subfield is allocated to each subfield SF1 to SF5. In an example shown in FIG. 3, the number of sustaining pulses in the sustention periods 31, 32, 33, 34 and 35 of each subfield SF1 to SF5 is approximately 16:8:4:2:1. Hereby, gradations from a gradation 0 at which no emission is made in any of subfields SF1 to SF5 to a gradation 31 (=16+8+4+2+1) at which emission is made in all subfields SF1 to SF5 can be represented. As the displayable maximum luminance (the gradation 31) is determined by the total of sustaining pulses in the sustention periods 31, 32, 33, 34 and 35 of the subfields SF1 to SF5, the luminance cannot be secured enough and satisfactory image quality cannot be acquired when time which does not contribute to emission such as the address control period 20 in one field is long. The address control period 20 requires time proportional to the number of displayed lines and one address control period is required for one field. Therefore, in case a high-resolution display panel is to be realized, there is a problem that subfields of the enough number cannot be secured, the number of display gradations is short and the luminance and image quality are deteriorated.

Figure 4:
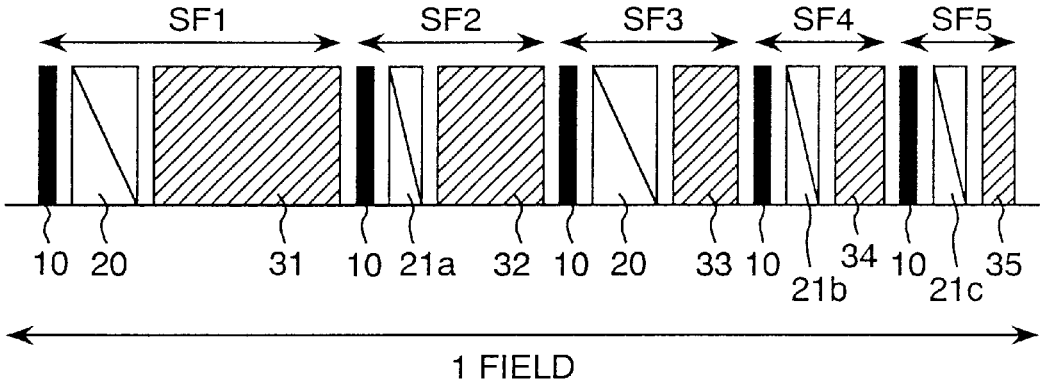
FIG. 4 is a schematic drawing showing an embodiment of field configuration according to the invention that one field is constituted of plural subfields.

FIG. 4 is a schematic drawing showing an embodiment of field configuration according to the invention that one field is constituted of plural subfields and shows field configuration that the address control periods in SF2, SF4 and SF5 having relatively small weight of emission of the subfields SF1 to SF5 are set to half length, compared with the conventional type field configuration shown in FIG. 3. The address control periods in SF1 and SF3 are the same as the conventional type address control periods shown in FIG. 3.

As shown in FIG. 4, reference numbers 21*a* to 21*c* denote address control periods which in the subfields SF2, SF4 and SF5 are set to half length, compared with those shown in FIG. 3. The configuration of the other is equal to that of the same reference number shown in FIG. 3. In the subfields SF1 and SF3, as shown in FIG. 3, a discharge cell is initialized in the reset period 10, and lighted picture elements and unlighted picture elements are selected every line in the address control period 20. In the sustention periods 31 and 33, the picture elements selected in the address control periods 20 are emitted according to respective weight of emission. The address control periods 21 respectively following the reset periods 10 in the subfields SF2, SF4 and SF5 are reduced by the thinning out of data as a result of simultaneously performing addressing for adjacent two lines and address control processing is executed by half time per line.

Figure 6:
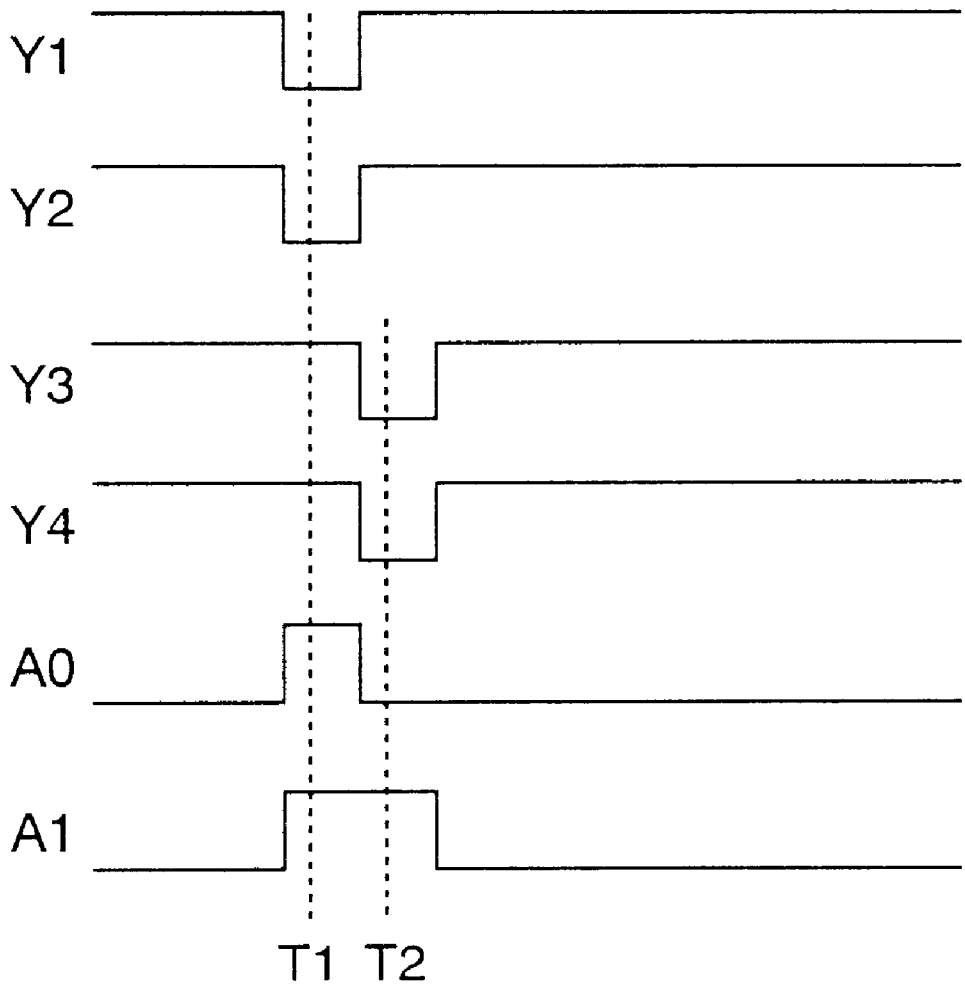
FIG. 6 is a waveform illustration showing an embodiment of voltage applied to the Y sustaining electrode and the address electrode in the address control period.

Referring to FIG. 6, processing for simultaneously controlling the lighting and unlighting of the Y sustaining electrodes for two lines and reducing the address control period up to a half will be described below.

FIG. 6 is a waveform illustration showing one embodiment of voltage applied to the Y sustaining electrode and the address electrode in the address control period of the display according to the invention. As shown in FIG. 6, addressing is simultaneously performed for two lines based upon the same data by simultaneously applying a scan pulse to the Y1 sustaining electrode 5201 and the Y2 sustaining electrode 5202. Next to the Y1 sustaining electrode 5201 and the Y2 sustaining electrode 5202, the Y3 sustaining electrode 5203 and the Y4 sustaining electrode 5204 are simultaneously processed. Time required for scanning total lines on one screen can be reduced up to a half by simultaneously applying a scan pulse to two lines and performing addressing as described above.

In the example shown in FIG. 4, addressing is simultaneously performed for two lines, however, the invention is not limited to two lines, three lines or four lines may be also simultaneously processed and at this time, required address time can be reduced up to ⅓ or ¼.

The invention is characterized in that subfields are divided into a group of high order subfields including the most significant subfield and a group of low order subfields except them, for the group of high order subfields, addressing is performed every line as in the prior art and for the group of low order subfields to which relatively small weight of emission is allocated, an address processing period is reduced up to a half. Further, for one subfield in the group of the low order subfields, as an independent control subfield, addressing is performed every line as in the prior art.

In the embodiment shown in FIG. 4, the group of the high order subfields includes SF1, the group of low order subfields includes SF2, SF3, SF4 and SF5 and the independent control subfield is SF3. The group of high order subfields means high order subfields including the most significant subfield, SF1 and SF2 may be also included in the group of high order subfields and in this case, the group of low order subfields includes SF3, SF4 and SF5. Any subfield in the group of low order subfields except the subfield to which the largest weight of emission is allocated is set to the independent control subfield. For example, SF4 or SF5 can be set to the independent control subfield. In case any subfield to which the largest weight of emission is allocated in the group of low order subfields is set to the independent control subfield, subfields up to this independent control subfield can be regarded as high order subfields and this case is similar to a case that there is no independent control subfield in the low order subfields.

The configuration that three or four lines are simultaneously processed and the address processing period is reduced up to ⅓ to ¼ may be also adopted except the configuration that the address processing period is reduced to a half by simultaneously processing two lines.

The vertical resolution information of low order subfields to which small weight of emission is allocated is lost by simultaneously processing plural lines in the low order subfields as described above, however, a flat part of an image can be smoothly displayed substantially without a problem. As a signal of an edge is reproduced in the high order subfields to which large weight of emission is allocated, the deterioration of image quality is hardly caused and high-luminance image display is implemented.

The details are described later, however, display in which the deterioration of image quality is small is also implemented in an area in which a signal level gently varies by newly providing an independent control subfield characterized by the invention.

As described above, an address control period which does not directly contribute to emission in one field is reduced by simultaneously controlling addresses on plural lines in a specific subfield, a period equivalent to the quantity is allocated to the sustention periods 31, 32, 33, 34 and 35 and the luminance of the screen can be enhanced. A new subfield can be also added utilizing excess time produced by the reduced address period so as to enhance image quality.

Figure 5:
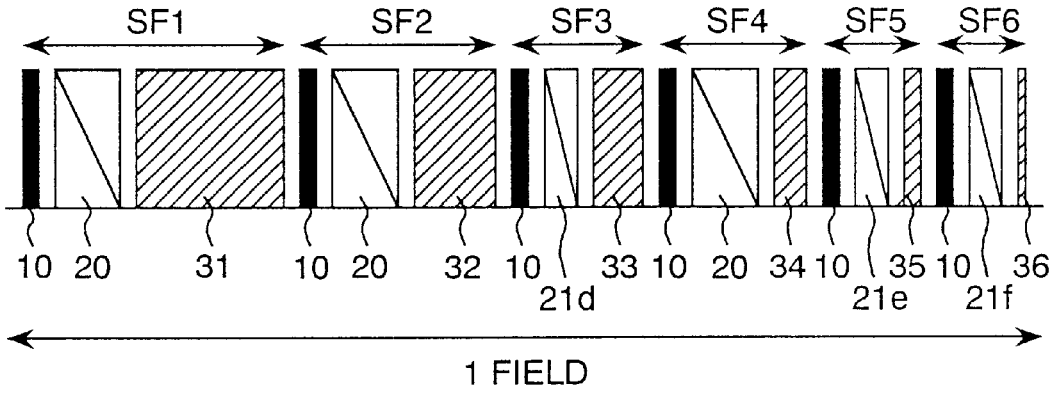
FIG. 5 is a schematic drawing showing another embodiment of field configuration according to the invention that one field is constituted of plural subfields.

FIG. 5 is a schematic drawing showing another embodiment of the field configuration according to the invention that one field is constituted of plural subfields and shows configuration that a subfield SF6 is increased keeping the maximum luminance (sum of sustention periods of each SF) similar, compared with the conventional type field configuration shown in FIG. 3. As shown in FIG. 5, reference numbers 21*d* and 21*f* denote an address control period set to a half, compared with the address control periods of the subfields SF3, SF5 and SF6 shown in FIG. 3 and 36 denotes a sustention period of the added subfield SF6. The other configuration corresponds to the configuration of the same reference number shown in FIG. 3.

As shown in FIG. 5, in subfields SF1, SF2 and SF4, a discharge cell is initialized in a reset period 10, and lighted picture elements and unlighted picture elements are selected every line in the address control period 20 as in the case shown in FIG. 3. In sustention periods 31, 32 and 34, the picture elements selected in the address control period are emitted according to respective weight of emission.

In the subfields SF3, SF5 and SF6, in the address control period 21 following the reset period 10, addressing is performed in half time by simultaneously performing addressing for two lines and the control of lighting and unlighting is made by equal data by two lines. In the succeeding sustention periods 33, 35 and 36, emission is made on the line selected in the addressing. That is, a group of high order subfields includes SF1 and SF2, a group of low order subfields includes SF3, SF4, SF5 and SF6 and an independent control subfield is SF4.

As described above, according to this embodiment, one field period can include the six subfields SF1 to SF6 by reducing each address control period 21 of the subfields SF3, SF5 and SF6 up to a half. Sixty-four gradations can be displayed by setting the emission ratio of these sustention periods 31, 32, 33, 34, 35 and 36 to 32:16:8:4:2:1. In this embodiment, as the address control periods of the subfields SF3, SF5 and SF6 can be processed in half time though the address period and the reset period of the subfield SF6 are newly increased, the total of all sustention periods in one field period can be substantially equal to that in the conventional type configuration shown in FIG. 3. Hereby, in this embodiment, the number of displayed gradations can be increased in a state in which luminance substantially equal to that in the conventional type method is kept and the high-quality display can be realized.

In this embodiment, as a signal of an edge requiring much information though the frequency is low can be correctly represented by independently controlling the high order subfields including the most significant subfield every line, the deterioration of image quality caused by reducing address control periods can be reduced as a whole. When this is applied to a case of high gradation representation, SF1 to SF3 have only to be set to a group of high order subfields, SF4 to SF8 have only to be set to a group of low order subfields and SF5 has only to be set to an independent control subfield in eight subfields which can be represented at 256 gradations for example SF1 to SF8 having the emission ration of 128:64:32:16:8:4:2:1. That is, the same data has only to be displayed for two lines in the subfields SF4, SF6, SF7 and SF8 and address processing has only to be performed every line in the high order subfields SF1, SF2 and SF3 including the most significant subfield in addition to the independent control subfield SF5 as in the prior art.

For an applied example of this embodiment, a display mode the luminance of which is low though the mode has high resolution in which no reduction is made in the address control period if necessary and a display mode the luminance of which is high though the mode has low resolution in which the address control periods of more subfields are reduced may be also switched if necessary. For example, when the display is used for a monitor of a computer, high-resolution display in which no address control period is reduced is made, when a picture signal is displayed, the same data is displayed for two lines in the two subfields SF5 and SF6 out of the eight subfields SF1 to SF8 and the two modes may be also switched to enable high-luminance display.

Furthermore, a range of the adjustment of the luminance may be also expanded by increasing subfields by the mode in which address control periods of two subfields are reduced and the reduction of address control periods of three subfields or the reduction of address control periods of four or five subfields according to the luminance of the periphery of the display, user setting and a level of a picture signal.

As a result of examining that an image the deterioration of the quality of which is small can be displayed if to which subfield of eight subfields that enable the representation of 256 gradations address compression is applied based upon the results of subjective evaluation experiments using computer simulation, the following result is acquired.

Number of subfields to which address compression is applied: 1 [0, 0, 0, 0, 0, 0, 0, 1]

Number of subfields to which address compression is applied: 2 [0, 0, 0, 0, 0, 0, 1, 1]

Number of subfields to which address compression is applied: 3 [0, 0, 0, 0, 0, 1, 1, 1]

Number of subfields to which address compression is applied: 4 [0, 0, 0, 1, 0, 1, 1, 1]

Number of subfields to which address compression is applied: 5 [0, 0, 1, 0, 1, 1, 1, 1]

Number of subfields to which address compression is applied: 6 [0, 1, 1, 0, 1, 1, 1, 1]

Number of subfields to which address compression is applied: 7 [1, 1, 1, 0, 1, 1, 1, 1]

In representation shown above, a part on the left side denotes high order subfields corresponding to most significant bits (MSB), a part on the right side denotes low order subfields corresponding to least significant bits (LSB), a subfield in which address time is reduced by two-line simultaneous address is shown by '1'0 and a subfield in which display is made depending upon an address in normal units of line is shown by '0'. That is, incase the subfields are shown in the order of SF1, SF2, SF3, - - - , SF8 from the left, address time is reduced in SF3, SF5, SF6, SF7 and SF8 if the number of subfields to which address compression is applied is 5.

To realize the above-mentioned case that the number of subfields to which address compression is applied is 4 [0, 0, 0, 1, 0, 1, 1, 1], high order three subfields SF1 to SF3 have only to be set to a group of high order subfields, low order five subfields SF4 to SF8 have only to be set to a group of low order subfields and a fourth subfield SF5 from the least significant bit has only to be set to an independent control subfield.

Similarly, to realize the above-mentioned case that the number of subfields to which address compression is applied is 6 [0, 1, 1, 0, 1, 1, 1, 1], high order one subfield SF1 has only to be set to a group of high order subfields, low order seven subfields SF2 to SF8 have only to be set to a group of low order subfields and a fifth subfield SF4 from the least significant bit has only to be set to an independent control subfield.

It is verified based upon subjective evaluation experiments that display having satisfactory image quality is implemented by setting a subfield equivalent to a fourth or fifth bit from the least significant bit to an independent control subfield and this phenomenon can be also explained by a character of the following image. It is known that in the case of a general natural image, the amplitude distribution of difference information of adjacent picture elements, that is, difference between the amplitudes of upper and lower adjacent two picture elements is plus distribution. This shows a characteristic that the frequency of a small amplitude in the vicinity of zero is extremely high and the frequency of difference information related to a large amplitude is small. That is, it is shown that in the case of upper and lower adjacent two picture elements, difference between the two picture elements is often zero (at the same level) or is often slight. However, generally, in a flat part in which a signal at a level in a predetermined range continues, even if very slight difference in a level is made between adjacent two picture elements, the difference is not visually recognized and hardly becomes large disturbance. In the meantime, in case the whole screen shows gentle variation, difference in a level of small amplitude to be recognized properly becomes zero by low order bit data commonizing processing, is recognized as the pairing of lines (difference in a level between two lines) and becomes disturbance. Then, the deterioration of image quality can be effectively improved by reproducing difference of small amplitude in the vicinity of a level at which difference in a level starts to be striking. Actually, when two-line simultaneous addressing is performed to a subfield equivalent to a fourth or fifth bit in case subfields which are simultaneously addressed based upon the same data for two lines are gradually increased from a subfield equivalent to the least significant bit, it is verified from subjective evaluation experiments that line pairing and difference in a level become remarkable because signal levels of two lines become substantially equal in an area such as a human skin in which a level gently varies.

Then, the deterioration of image quality can be greatly reduced by representing a difference component of small amplitude using an independent subfield. As described above, this independent subfield has the effect of reducing a display error even if the independent subfield is a subfield having small weight of emission, however, even if original minute difference in a level can be represented without an error, the visual effect of improvement is low. Therefore, a striking error of small amplitude can be reduced by independently controlling a subfield equivalent to a fourth or fifth bit from the least significant bit and satisfactory image quality display is implemented.

When a display mode that no address control period is reduced if necessary and a display mode that the address control periods of more subfields are reduced can be switched if necessary, the position of the added independent subfield may be also varied according to the number of reduced subfields. A subfield which is not reduced in any setting and which can be controlled in units of line can be suitably arranged by this and display of high image quality is implemented.

Next, referring to FIG. 7, the configuration of the display to which subfield configuration in each embodiment described above is applied will be described.

Figure 7:
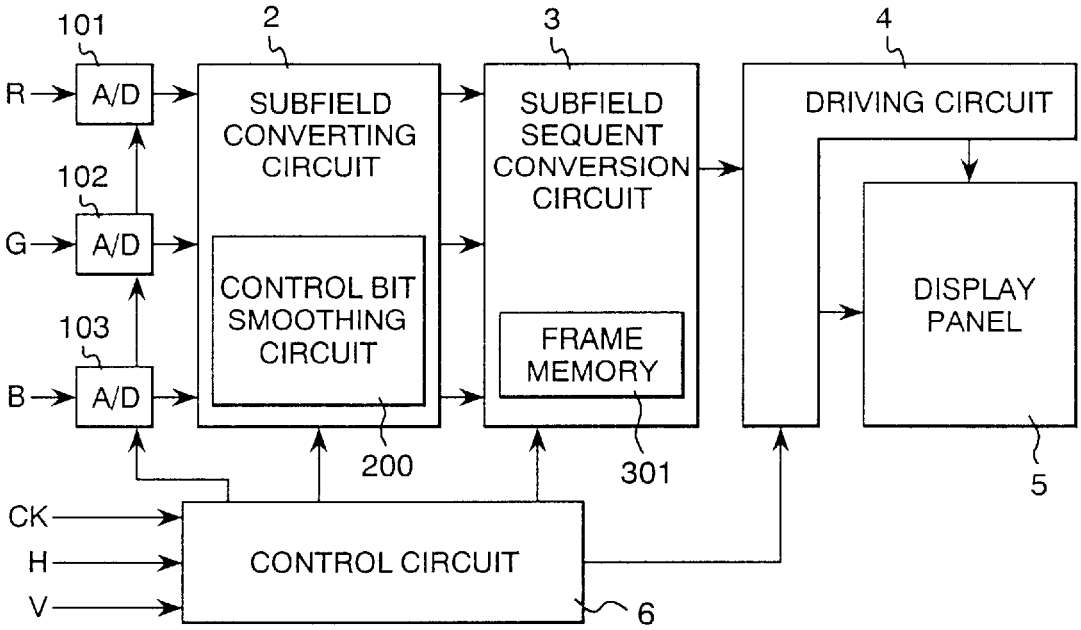
FIG. 7 is a block diagram showing an embodiment of a display according to the invention.

FIG. 7 is a block diagram showing an embodiment of the display according to the invention.

As shown in FIG. 7, reference numbers 101, 102 and 103 denote A/D converters that respectively convert any analog picture signal of R, G, B to a digital signal, 2 denotes a subfield converting circuit that converts a binary digital signal converted from analog to digital to subfield data showing the lighting and unlighting of a subfield, 20 denotes a control bit smoothing circuit which is provided inside the subfield converting circuit 2 and which executes the smoothing processing of a control bit corresponding to a subfield the address control period of which is reduced by two-line simultaneous addressing, 3 denotes a subfield sequent conversion circuit that converts subfield data generated in units of picture element to a plane-sequent form in units of subfield, 301 denotes a frame memory provided to the subfield sequent conversion circuit 3 for realizing plane sequence in units of bit, 4 denotes a driving circuit that adds a pulse required for driving to a signal converted to a format of plane sequence in units of subfield and converts it to voltage (or current) for driving the display, 5 denotes a display panel on which gradation representation is made in the subfield mode and 6 denotes a control circuit that generates a control signal required for each block based upon a dot clock CK which is timing information of an input picture signal, a horizontal synchronizing signal H, a vertical synchronizing signal V and others.

Each input signal of R, G, B is converted to a digital signal by the A/D converters 101, 102 and 103. This digital signal complies with general binary notation and each bit has the weight of power of 2. Concretely, when an 8-bit signal of b0, b1, - - - , b6, b7 is quantized, the least significant bit b0 has the weight of 1, b1 has the weight of 2, b2 has the weight of 4, b3 has the weight of 8, - - - , and b7 has the weight of 128. The digital signal is converted to subfield data showing the lighting and unlighting of a subfield in the subfield converting circuit 2.

This subfield data is constituted of information having the number of bits corresponding to the number of subfields for display and when display is made by eight subfields, a signal is constituted of eight bits of S0, S1, - - - , S7. Further, a bit S0 shows whether the picture element emits in an emission period of the leading subfield SF1 or not and similarly, S1 and S2 correspond to the lighting and unlighting of the subfields SF2 and SF3.

Further, in a control bit smoothing circuit 200, the smoothing processing of a control bit corresponding to a subfield an address control period of which is compressed is executed. This is processing for converting so that the corresponding control bit is the same data as subfield data on the upside by one line or subfield data under on the downside by one line to be a pair for two-line simultaneous addressing using the same control bit. The subfield control bit smoothing processing will be described later.

Next, the subfield data is input to the subfield sequent conversion circuit 3 and is written to the frame memory 301 provided inside the subfield sequent conversion circuit 3 in units of picture element. Reading from the frame memory 301 is performed according to plane sequence in units of subfield. That is, after the bit S0 showing whether emission occurs in the subfield SF1 or not is read for one field, the bit S1 showing whether emission occurs in the subfield SF2 or not is read, hereinafter, bits are read in the order of S2, S3, - - - , S7 and each subfield is constituted by outputting them as address data. At this time, in a subfield the address control period of which is compressed, one of two lines is thinned out and the data of a half of lines is read as address data. Afterward, the conversion of a signal required for driving the display and the insertion of a pulse are performed in the driving circuit 4 and a matrix display panel 5 is driven.

As can pulse output together with address data of the address control period is output at timing shown in FIG. 2 in a subfield in which addressing is performed in units of normal line and is output at timing shown in FIG. 6 in a subfield in which addressing is simultaneously performed for two lines and the control period is compressed. FIG. 6 shows the waveforms of voltage applied to the Y sustaining electrode and the address electrode in the address control period.

The address control period of a predetermined subfield can be reduced by configuring as described above and the display of high image quality can be realized by allocating surplus time produced by the reduction of the address control period to the sustention period so as to enhance the luminance, increasing the number of displayed gradations by increasing the number of subfields and enhancing resistance to pseudo contour interference. All data is written to the frame data 301 and when the address control period is compressed in reading, one of two lines is thinned out, however, one of two lines may be also thinned out in writing. Hereby, memory capacity can be reduced and even if the memory has the same capacity, high-resolution or multiple-gradation display is implemented.

In case processing for reducing pseudo contour interference is executed by increasing the number of subfields or allocating the weight of emission different from the power of 2, conversion from an input picture signal level to a subfield emission pattern is made in the subfield converting circuit 2. For example, in case an 8-bit input picture signal is displayed in ten subfields, conversion from the 8-bit input signal to 10-bit subfield data is made in a combinational logic circuit or using a lookup table.

Next, referring to FIG. 8, the configuration of the control bit smoothing circuit 200 will be described.

Figure 8:
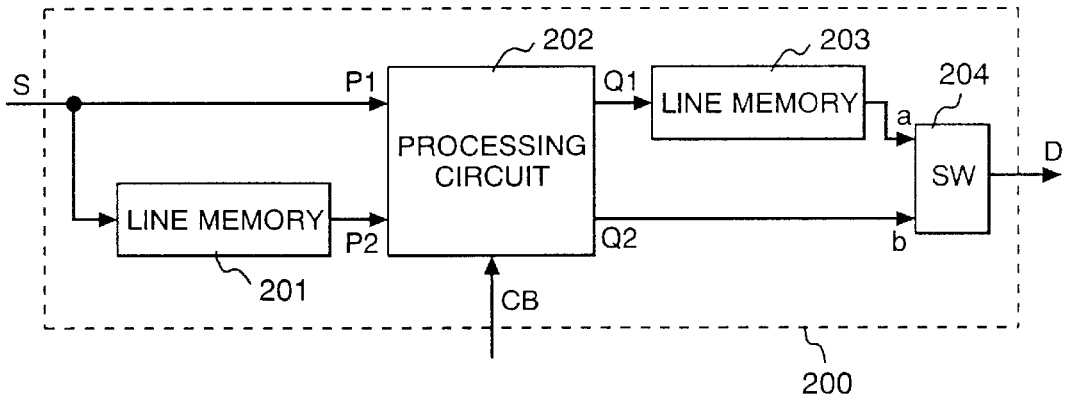
FIG. 8 is a block diagram showing an embodiment of a control bit smoothing circuit shown in FIG. 7.

FIG. 8 is a block diagram showing an embodiment of the control bit smoothing circuit shown in FIG. 7.

As shown in FIG. 8, a reference number 201 denotes a line memory for delaying subfield data by one line, 202 denotes a processing circuit that converts so that bit data specified by a control signal CB is equal to two inputs P1 and P2 and outputs Q1 and Q2, 203 denotes a line memory for delaying the output Q1 of the processing circuit 202 by one line and 204 denotes a switching circuit that switches two inputs a and b in units of line and outputs it.

Subfield data S in which the lighting and unlighting of each subfield are related to bit data is input to the line memory 201 and the input terminal P1 of the processing circuit 202. Conversion is made based upon the subfield data delayed by one line in the line memory 201 is input to the input terminal P2 of the processing circuit 202. In the processing circuit 202, conversion is made based upon the subfield data from the input terminal P1 and the subfield data delayed by one line from the input terminal P2 so that predetermined bit data is equal to the subfield data of upper and lower adjacent two picture elements on the current line and a line on the upside by one line. The subfield data to which such conversion is applied are output from the processing circuit 202 as outputs Q1 and Q2. As the outputs Q1 and Q2 of the processing circuit 202 are the subfield data of picture elements vertically adjacent on the screen, they can be converted to subfield data D in which predetermined bit data has the same value on two lines by delaying the output Q1 by one line in the line memory 203, switching the switching circuit 204 every line and sequencing signals of two lines.

The position of a bit processed in the processing circuit 202 to be equal bit data is determined according to the control signal CB and it can be set the address control period of which subfield is reduced. Setting in case no reduction of the address control period is performed is also made according to the control signal CB and at this time, the processing circuit 202 outputs input P1 as output Q1 as it is and outputs input P2 as output Q2 as it is.

In the above description related to FIG. 8, the subfield data S in which the lighting and unlighting of each subfield are related to bit data is input to the line memory 201 and the input terminal P1 of the processing circuit 202, however, a signal S of a natural binary number is input from the A/D converter, is processed so that bit data equivalent to a desired subfield is equal on adjacent two lines and the output D of the control bit smoothing circuit 200 may be also converted to a subfield emission control signal showing the lighting and unlighting of each subfield. For the simplest configuration of the processing circuit 202, predetermined bit data of input P1 is output as bit data at the same position of input P2 as it is. Hereby, both bit data can be equal. Or conversely, predetermined bit data of input P2 maybe also output as bit data at the same position of input P1. Either method may be also selected to reduce an error with an input signal. In configuration except this, it has only to be also considered that the outputs Q1 and Q2 of bit data specified by the control signal CB are equal and difference caused by conversion with an input signal is reduced. At this time, if necessary, a signal except a bit specified by the control signal CB may be also changed so that difference caused by conversion with an input signal is reduced.

In case the data of upper and lower adjacent low order n bits are equalized unconditionally, display data greatly varies, the great deterioration of image quality may be also caused and to prevent this, any processing is required. For example, in case the data of an adjacent upper picture element is at a level 16 and the data of the lower picture element is at a level 15, the level 16 is represented as [1, 0, 0, 0, 0] (1 denotes a subfield in which emission occurs and 0 denotes a subfield in which no emission occurs) in subfield representation depending upon the weight of emission of the power of 2 and the level 15 is represented as [0, 1, 1, 1, 1]. At this time, suppose a case that one of two lines is thinned out to be the same data in subfields equivalent to low order four bits according to a procedure of a jump. In this case, the low order four subfields [1, 1, 1, 1] of the lower picture element 15 [0, 1, 1, 1, 1] is replaced by the low order four subfields [0, 0, 0, 0] of the upper picture element 16 [1, 0, 0, 0, 0]. As a result, a represented level is [0, 0, 0, 0, 0] and the picture element at a level 15 originally becomes a level 0.

Conversely, when the low order four subfields of the upper picture element 16 [1, 0, 0, 0, 0] are replaced using the low order four subfields [1, 1, 1, 1] of the lower picture element 15 [0, 1, 1, 1, 1] to be the same, the upper picture element at a level 16 originally becomes a level 31 [1, 1, 1, 1, 1].

The invention is first characterized in that to inhibit such extreme variation of a level and the occurrence of a flicker, a signal processing circuit that processes referring to signals of plural lines the low order subfields of which are common so that the image quality is hardly deteriorated and predetermined subfield data are equal is provided.

Further, the invention is second characterized in that the image quality is improved by providing an independent control subfield in a group of common low order subfields.

Next, referring to FIG. 9, an example of the operation and the configuration of the processing circuit 202 provided inside the control bit smoothing circuit 200 shown in FIG. 8 will be described.

Figure 9:
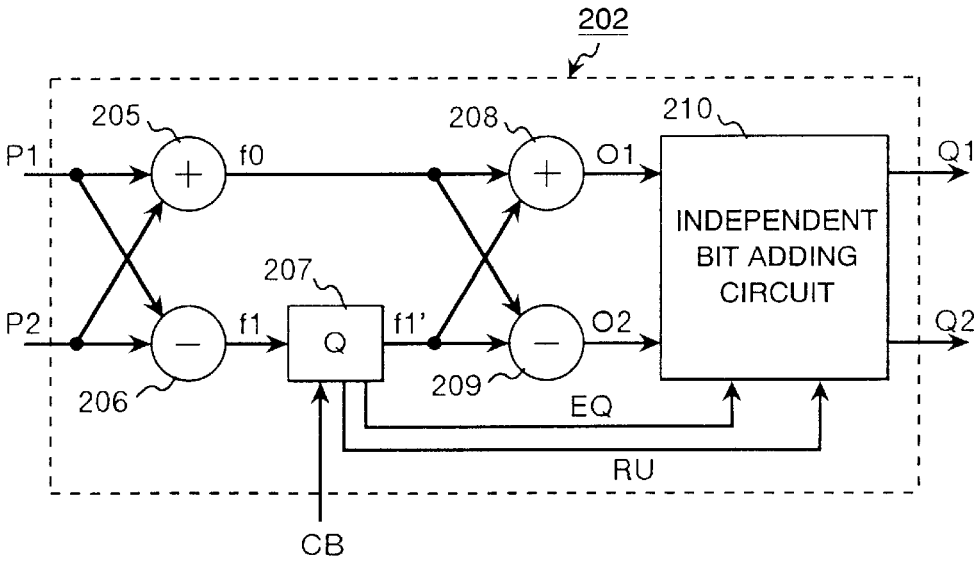
FIG. 9 is a block diagram showing an embodiment of a processing circuit shown in FIG. 8.

FIG. 9 is a block diagram showing an embodiment of the processing circuit shown in FIG. 8.

As shown in FIG. 9, reference numbers 205 and 208 denote an adding circuit, 206 and 209 denote a subtracting circuit, 207 denotes a quantizing circuit the characteristic of which varies according to a control signal CB from an external device, 210 denotes an independent bit adding circuit and 202 denotes a processing circuit.

Picture elements P1 and P2 adjacent in a vertical direction input to the processing circuit 202 are input to the adding circuit 205 and the subtracting circuit 206. In the adding circuit 205, P1 and P2 are added and an average value f0 is calculated as shown in a mathematical expression (1). In the subtracting circuit 206, P2 is subtracted from P1 and a value f1 based upon difference shown in a mathematical expression (2) is calculated.

$$f0=(P1+P2)/2 \quad (1)$$

$$f1=(P1-P2)/2 \quad (2)$$

"f1" is input to the quantizing circuit 207 and is converted to f1'. The quantizing circuit 207 processes so that a low order bit specified by the control signal CB is '0'.

"f0" generated in the adding circuit 205 is added to a signal f1' the desired low order bit of which is converted to 0 by the control signal CB in the adding circuit 208 and is output as converted output 01. In the subtracting circuit 209, f1' is subtracted from f0 and is output as converted output 02.

Operation by the adding circuit 208 and the subtracting circuit 209 is shown in a mathematical expression (3) and a mathematical expression (4).

$$O1=f0+f1' \quad (3)$$

$$O2=f0-f1' \quad (4)$$

As low order n bits of f1' are 0, low order n bits of f0 are output as an equal value as they are for the respective low order n bits of O1 and O2 acquired by adding or subtracting f0/from f0. That is, the respective low order n bits of O1 and O2 are equalized. Strictly speaking, as addition and subtraction have the equal result of calculation (operation according to binary notation) in a state without carrying and borrowing, the data of a low order 'n+1'th bit can be converted so that it is equal in O1 and O2. The average value (O1+O2)/2 of the outputs O1 and O2 at this time is always equal to the average value f0 of inputs P1 and P2 and the average signal level of adjacent two lines can be always kept the same. As an error caused by equalizing low order bits is equally dispersed by (|f1−f1'|) in both O1 and O2, an error of conversion does not concentrate on a specific picture element and the mean square error of an input image and the converted image can be minimized.

It is clear that in case f1=f1', P1=O1 and P2=O2 without an error and it is determined based upon a characteristic of quantization from f1 to f1' by the quantizing circuit 207 how many low order bits are commonized.

After all low order bits equivalent to a group of low order subfields are converted in the above-mentioned processing so that those bits for adjacent two lines are equal, Q1 and Q2 are input to the independent bit adding circuit 210 and are output as Q1 and Q2 to which a predetermined independent bit is added.

Information EQ and RU based upon an error of conversion when f1 is converted to f1'0 in a process of quantizing processing are output from the quantizing circuit 207 to control the operation of the independent bit adding circuit 210. The details of EQ and RU and the operation of the independent bit adding circuit 210 will be described later.

Owing to the above-mentioned configuration, the deterioration of image quality depending upon bit data equivalent to a group of low order subfields is minimized and in addition, low order bit data for adjacent two lines can be commonized. As the operation of ½ can be realized by rounding down low order bits, it is not definitely shown, however, as shown in the mathematical expressions (1) and (2), the output of the adding circuit 205 and the subtracting circuit 206 may be halved. To reduce an error of rounding in operation, a device connected to the adding circuit 208 and the subtracting circuit 209 may also halve. The characteristic of the quantization of the quantizing circuit 207 is controlled according to a control signal CB and it can be controlled according to setting of the control signal CB from an external device how many low order bits are commonized.

It is conceivable that the average signal level f0 of two lines is a low frequency component in the vertical direction of an image and a value f1 based upon difference between two lines is a high frequency component in the vertical direction. The high frequency component f1 in the vertical direction becomes 0 in a subfield equivalent to a low order bit by the quantizing circuit 207 and only the low frequency component of f0 is included. Hereby, the low order subfield is limited to a low frequency component the vertical resolution of which is only f0 and display in a state in which the number of data in the address control period is thinned out (the same data is simultaneously addressed) can be made.

The resolution information of a specific subfield equivalent to a desired bit can be limited by dividing into plural vertical frequency components, selecting a bit to be added or subtracted by the quantizing means and synthesizing again as described above and hereby, the first characteristic of the invention to reduce the address control period can be acquired.

Next, referring to FIGS. 10 and 11, the addition of an independent control subfield which is a second characteristic of the invention and the effect will be described.

FIGS. 10A to 10D show a state of bits of each signal output to terminals O1, O2, Q1 and Q2 shown in FIG. 9. As shown in FIGS. 10, each signal is constituted of k bits (k=8 in FIGS. 10), MSB (a bit k−1) is located on the left side and MSB (a bit 0) is located on the right side.

Figure 10A:
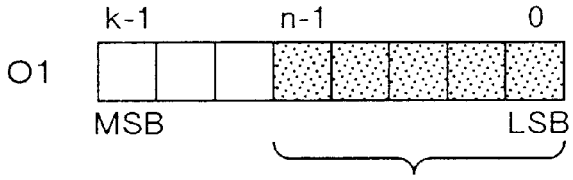
FIGS. 10(*a*)–(*d*) show a state of a bit of a signal respectively output to terminals 01, 02. Q1 and Q2 shown in FIG. 9.
Figure 10B:
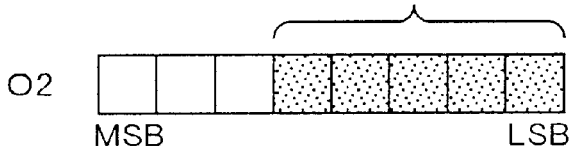

FIG. 10A shows the output O1 of the adding circuit 208 and FIG. 10B shows the output O2 of the subtracting circuit 209. Low order n bits (n=5 in FIG. 10) are processed so that those in O1 and O2 are equal according to the setting of the quantizing circuit 207.

Figure 10C:
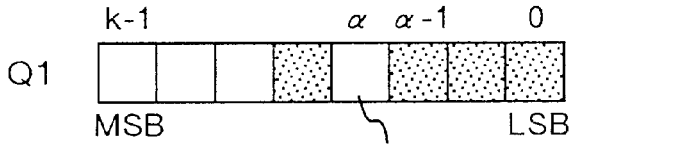
Figure 10D:
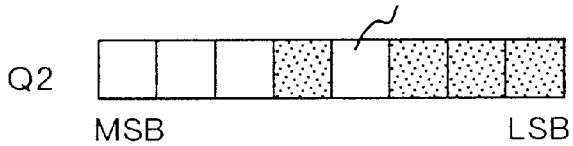
Figure 11A:
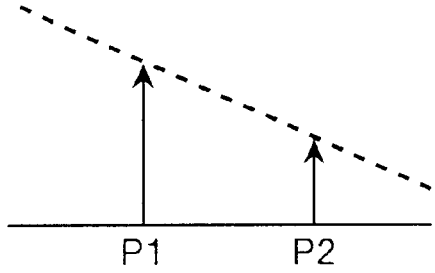
FIGS. 11(*a*)–(*c*) are explanatory drawings for explaining the principle of reducing the deterioration of image quality by an added independent bit.
Figure 11B:
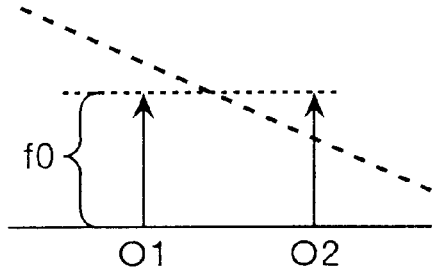
Figure 11C:
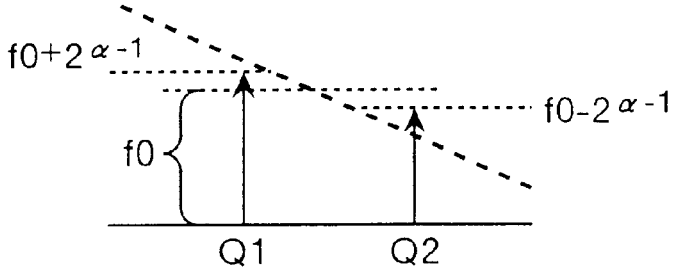

FIGS. 10C and 10D show the outputs Q1 and Q2 of the independent bit adding circuit 210 shown in FIG. 9 and a bit α is added as an independent bit. The position of the bit α is set to any of a bit 0 to a bit n−O2. (In FIGS. 10, α=3 and the bit α is equivalent to a low order fourth bit.) FIGS. 11 are explanatory drawings for explaining the principle of reducing the deterioration of image quality by the added independent bit. FIG. 11A shows input picture elements P1 and P2 vertically adjacent and input to the processing circuit 202 shown in FIG. 9 and shows a part of a signal having gentle slope. FIG. 11B shows the output O1 of the adding circuit 208 shown in FIG. 9 and the output O2 of the subtracting circuit 209, and both O1 and O2 are converted to the average value f0 of P1 and P2 by quantizing f1' to zero by processing in the quantizing circuit 207. FIG. 11C shows the outputs Q1 and Q2 of the independent bit adding circuit 210, Q1 and Q2 are not at the same level by the addition of the independent bit but difference in a level equivalent to the αth power of 2 can be made. To minimize a mean square error caused by conversion, ½ of the difference of the αth power of 2 has only to be equally distributed to Q1 and Q2 as shown in FIG. 11C and hereby, the average value of Q1 and Q2 is equal to the average value f0 of P1 and P2.

Display output signals Q1 and Q2 can be made at a level close to the original images of P1 and P2 by above-mentioned processing and there is effect of inhibiting the deterioration of image quality. The location of the independent control bit α can be controlled according to a control signal CB from an external device, the configuration including subfields simultaneously addressed by the same data for two lines and a subfield independently controlled in units of line is suitably set and an image the quality of which is hardly deteriorated can be always displayed.

Next, referring to FIG. 12, an example of the concrete configuration of the independent bit adding circuit 210 shown in FIG. 9 will be described.

Figure 12:
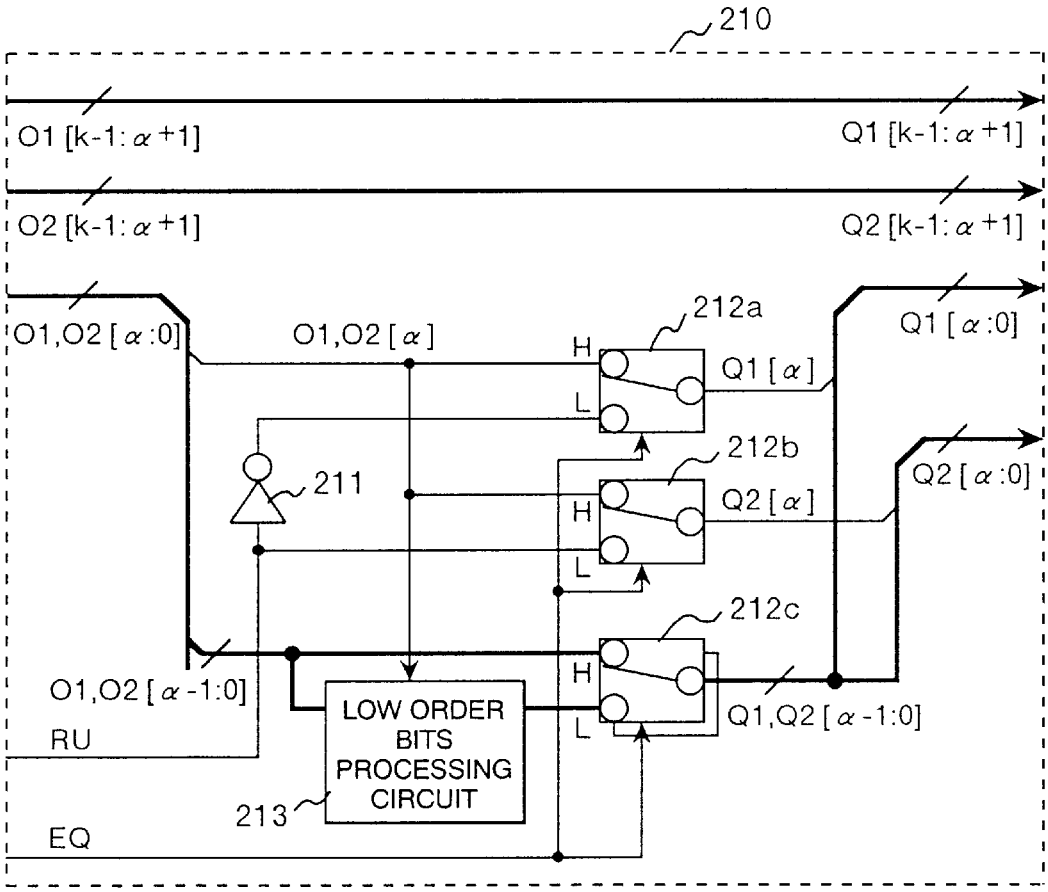
FIG. 12 is a block diagram showing an embodiment of an independent bit adding circuit shown in FIG. 9.

FIG. 12 is a block diagram showing an embodiment of the independent bit adding circuit shown in FIG. 9.

As shown in FIG. 12, a reference number 211 denotes a logic inverting circuit, 212*a* and 212*b* denote a switching circuit, 212*c* denotes a bus switching circuit, 213 denotes a low order bits processing circuit and 210 denotes the independent bit adding circuit. O1 [n] shown in FIG. 12 denotes a single signal of a bit n (an (n+1)th bit from LSB, however, the bit may be 0) of a picture element O1 and O1 [n:m] denotes (n−m+1) pieces of bus signals from the bit n of the picture element O1 to a bit m. Another signal name is also similar. Of input pixel signals O1 and O2, the respective high order independent bits of O1 [k−1: α+1](in this case, n=k−1, m=α+1) and O2 [k−1: α+1] are output as the high order bits Q1 [k−1: α+1] and Q2 [k−1: α+1] of Q1 and Q2 as they are. The quantizing circuit 207 shown in FIG. 9 outputs two types of control signals EQ and RU generated according to the amount of an error caused when processing for quantizing f1' based upon f1 is executed and these two signals are input to the independent bit adding circuit 210.

The control signal EQ is a logic signal which has a value of 1 in case an error of conversion from f1 to f1' is relatively small, concretely, when the following mathematical expression (5) is met, the control signal EQ is at a high level and in other case, it is at a low level.

$$+\delta>(f1'-f1)>-\delta \tag{5}$$

However, (0<δ<[α power of 2]).

The control signal RU is a logic signal which has a value of 1 when an error of conversion from f1 to f1' is relatively large and f1' is converted so that it becomes large, concretely, when the control signal RU meets the following mathematical expression (6), it is at a high level and in other case, it is at a low level.

$$(f1'-f1)\geqq\delta \tag{6}$$

However, (0<δ<[α power of 2]).

"δ" is a threshold for determining whether an independent control bit is added or not and as a minute level varied by the independent control bit is [the (α−1) power of 2], the maximum effect is acquired when an error δ of quantization is [the (α−1) power of 2]. Therefore, δ may be (0<δ<[α power of 2]), however, to prevent excess correction, it is desirable that δ is in a range from [the (α−2) power of 2] to [the (α−1) power of 2].

Further, for a concrete example, δ=[(α−1) power of 2]×0.7. In case EQ=1 in FIG. 12 (in this case, RU=0), the switching circuits 212*a* and 212*b* are respectively switched to the side of a high level and commonized bits O1 and O2 [α:0] are output as a low order bit Q1 [α:0] of Q1 and a low order bit Q1 [α:0] of Q2 as they are via the switching circuits 212*a*, 212*b* and 212*c*. This shows that in case an error of conversion in the quantizing circuit 207 is small, output is made as it is without adding an independent bit.

In case EQ=0 and RU=1 as shown in FIG. 12, the switching circuits 212*a* to 212*c* are respectively switched to the side of a low level, RU (=1) is inverted in the inverting circuit 211 and Q1 ([α]=0) is output via the switching circuit 212*a*, RU (=1) is output as the independent bit of Q2 ([α]=1) as it is via the switching circuit 212*b*, For the low order Q1 [α−1:0], a signal processed in the low order bits processing circuit 213 is output via the switching circuit 212*c*. The details of the operation of the low order bits processing circuit 213 will be described later.

A case that EQ=0 and RU=1 means a case that f1' is converted to a larger value, compared with f1, at this time, O1 calculated based upon (f0+f1') is converted to a larger value than an original image P1 and 02 calculated based upon (f0−f1') is converted to a smaller value than an original image P2. Then, an error with each original image can be corrected by turning Q1 [α] as an independent bit to 0 and turning Q2 [α] to 1 so that the error becomes smaller.

As shown in FIG. 12, in case EQ=0 and RU=0, the switching circuits 212*a* to 212*c* are respectively switched to the side of a low level, RU (=0) is inverted in the inverting circuit 211 and Q1 ([α]=1) is output via the switching circuit 212*a*, RU (=0) is output as an independent bit of Q2 ([α]=0) as it is via the switching circuit 212*b*, For the low order Q1 [α−1:0], a signal processed in the low order bits processing circuit 213 is output via the switching circuit 212*c*.

A case that EQ=0 and RU=0 means a case that f1' is converted to a smaller value, compared with f1, at this time, O1 calculated based upon (f0+f1') is converted to a smaller value than the original image P1 and O2 calculated based upon (F0−f1') is converted to a larger value than the original image P2. Then, an error with each original image can be corrected by turning Q1 [α] as an independent bit to 1 and turning Q2 [α] to 0 so that the error becomes smaller.

By the above-mentioned operation, the independent bits Q1 [α] and Q2 [α] are corrected according to the control signals EQ and RU from the quantizing circuit 207 so that an error with each original image becomes smaller and the deterioration of image quality can be reduced.

FIG. 13 shows truth values of the operation of the independent bit adding circuit 210 shown in FIG. 12 for the control signals EQ and RU.

FIG. 13 shows the logic operation of the independent bit adding circuit. O1 [α] and O2 [α] respectively shown in FIG. 13 show that input O1 [α] and O2 [α] are output as Q1 [α] and Q2 [α] as they are. In FIG. 13, '1' denotes that Q1 or Q2 is a little increased and '0' denotes that Q1 and Q2 are unchanged.

When the independent control bits Q1 [α] and Q2 [α] are operated, O1 [α] and O2 [α] which are the same signal (0, 0) or (1, 1) are converted to (0, 1) or (1, 0) as Q1 [α] and Q2 [α]. At this time, as the average value of Q1 and Q2 is increased or reduced by [the (α−1) power of 2], compared with the average value of O1 and O2, the low order bits processing circuit 213 corrects. FIG. 15 is a truth table of the low order bits processing circuit 213.

The control signal EQ is a signal which becomes 1 when an error of quantization in the quantizing circuit 207 is in a range of ±δ and the control signal RU is a signal which becomes 1 when an error of the quantization is ±δ or more. Therefore, as it is impossible that EQ=1 and RU=1, the input is inhibited in FIG. 13.

The position α of the independent bit is controlled by the control signal CB shown in FIG. 9. A threshold δ showing whether the independent bit is added or not is also set together with the value of α.

Next, referring to a block diagram shown in FIG. 14 and the truth table shown in FIG. 15, the operation of the low order bits processing circuit 213 shown in FIG. 12 will be described.

Figure 14:
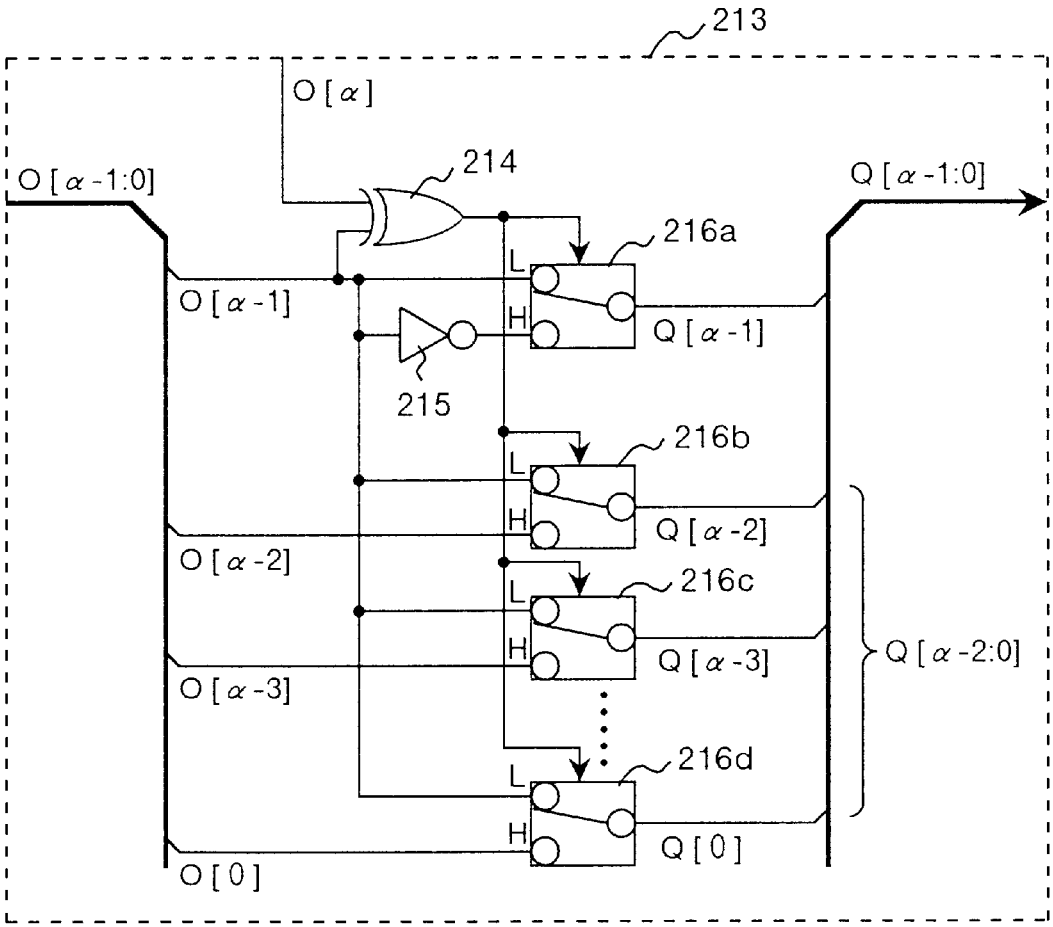
FIG. 14 is a block diagram showing an embodiment of a low order bit processing circuit shown in FIG. 12.

FIG. 14 is a block diagram showing an embodiment of the low order bits processing circuit shown in FIG. 12. As shown in FIG. 14, a reference number 214 denotes an exclusive-OR (EXOR) circuit, 215 denotes a logic inverting circuit, 216*a* to 216*d* denote a switching circuit and 213 denotes a low order bits processing circuit. The path representation of a signal and the representation of each bit are similar to those in FIG. 12. The low order bits processing circuit 213 is provided to correct that the average value of Q1 and Q2 increases or decreases by [the (α−1) power of 2], compared with the average value (also equal to the average of inputs P1 and P2) of O1 and O2 when O1 [α] and O2 [α] which are the same signal (0, 0) or (1, 1) are converted to (0, 1) or (1, 0) as Q1 [α] and Q2 [α] as described above. As low order bits of (α−1) and the following processed in the low order bits processing circuit 213 are converted to an equal value between O1 and O2 and between Q1 and Q2, they can be processed by one system of processing circuit. To simplify notation, O1 [α−1] and O2 [α−1] (both are equal) are represented as O [α−1], and Q1 [α−1] and Q2 [α−1] (both are also equal) are represented as Q [α−1]. As O1 [α] and O2 [α] are also equally converted, they are represented by O [α].

Referring to the truth table shown in FIG. 15, the operation will be described below.

FIG. 15 shows the logic operation of the independent bit adding circuit. In FIG. 15, O[α] is 1, O [α−1] is 0, in case Q1 [α] and Q2 [α] are independently converted to (1, 0) or (0, 1), either of Q1 [α] or Q2 [α] is 0 though O1 [α] and O2 [α] are both 1 and the average value of Q1 and Q2 decreases by [the (α−1) power of 2]. To correct this, Q [α−1](O [α−1]) is converted from 0 to 1. Hereby, the average value of Q1 and Q2 can be increased by [the (α−1) power of 2], as a whole, the average value of Q1 and Q2 can be equalized to the average value (also equal to the average of the inputs P1 and P2) of O1 and O2 and the deterioration of image quality can be reduced.

Similarly, in case O [α] is 0, O[α−1] is 1, and Q [α] and Q2 [α] are independently converted to 1, 0) or 0, 1), either of O1 [α] or O2 [α] becomes 1 through they are both 0 and the average value of Q1 and Q2 increases by [the (α−1) power of 2]. Ton correct this, Q[α−1] (O [α−1]) is converted from 1 to 0. Hereby, the average value of Q1 and Q2 can be reduced by [the (α−1) power of 2] and as a whole, the average value of Q1 and Q2 can be equalized to the average value (also equal to the average of the inputs P1 and P2) of O1 and O2.

Further, in case O [α] is 0, O [α−1] is 0, and Q1 [α] and Q2 [α] are independently converted to 1, 0) or 0, 1), either of Q1 [α] or Q2 [α] becomes 1 through O1 [α] and O2 [α] are both 0 and the average value of Q1 and Q2 increases by [the (α−1) power of 2]. To correct this, Q [α−1] has only to be converted from 1 to 0, however, as O [α−1] is already 0, the average value of Q1 and Q2 cannot be reduced by [the (α−1) power of 2] by simple bit operation. Then, to approach processing for reducing by [the (α−1) power of 2] possibly, all bits of Q [α−2:0] are converted to 0. Hereby, the average value of Q1 and Q2 can approach the average value (also equal to the average of the inputs P1 and P2) of O1 and O2 possibly.

Similarly, in case O [α] is 1, O [α−1] is 1, and Q1 [α] and Q2 [α] are independently converted to 1, 0) or (0, 1), either of Q1 [α] or Q2 [α] becomes 0 through O1 [α] and O2 [α] are both 1 and the average value of Q1 and Q2 decreases by [the (α−1) power of 2]. To correct this, Q [α−1] has only to be converted from 0 to 1, however, as O [α−1] is already 1, [the (α−1) power of 2] cannot be added by simple bit operation. Then, in place of processing for adding [the (α−1) power of 2] possibly, all bits of Q [α−2:0] are converted to 1. Hereby, the average value of Q1 and Q2 can approach the average value (also equal to the average of the inputs P1 and P2) of O1 and O2 possibly.

In case the independent bits Q1 [α] and Q2 [α] are operated by above-mentioned operation, the average value of Q1 and Q2 can be also always substantially equal to the average value (also equal to the average of the inputs P1 and P2) of O1 and O2 and hereby, the deterioration of image quality can be reduced.

To explain in an example of the configuration of a concrete circuit, as shown in FIG. 14, it is detected in the exclusive-OR (EXOR) circuit 214 whether O [α] and O [α−1] are equal or not. In case O [α] and O [α−1] are not equal, the output of the exclusive-OR (EXOR) circuit 214 is at a high level and all the switching circuits 216*a* to 216*d* are switched to the side of a high level as shown in FIG. 14. At this time, O [α−1] is inverted by the logic inverting circuit 215 and is output as Q [α−1] via the switching circuit 216*a*. The low order bits of O [α−2:0] are output as Q [α−2:0] as they are via the switching circuits 216*b* to 216*d*.

In case O [α] and O [α−1] are equal, the output of the exclusive-OR (EXOR) circuit 214 is turned at a low level and all the switching circuits 216*a* to 216*d* are switched to the side of a low level as shown in FIG. 14. Hereby, the values equal to o [α−1] of all signals of Q [α−1:0] are output via the switching circuits 216*a* to 216*d*.

It is clear that according to such configuration, the truth table shown in FIG. 15 can be realized and when an independent control bit is operated by such a low order bits processing circuit 213, the average value of displayed Q and Q2 can be also substantially equal to the average value of the original images P1 and P2.

In the embodiments shown in FIGS. 4, 5 and 10, only one subfield is independently controlled in a group of low order subfields, however, the invention is not limited one and plural subfields may be also independently controlled. The particle of noise caused by the diffusion of an error may be also finely controlled similarly as in prior art by independently controlling a subfield equivalent to a bit 4 or 5 according to this embodiment and independently controlling a bit equivalent to the least significant subfield.

According to the invention, the address control period of a predetermined subfield is reduced and this time can be allocated to the improvement of image quality in luminance, gradation and a pseudo contour.

As high order subfields including the most significant subfield are addressed every line as heretofore and a group of low order subfields having relatively small weight of emission is simultaneously addressed for two lines using the same data, the deterioration of image quality can be reduced.

Further, the quality of display can be further improved by providing a subfield independently addressed every line in a part of the group of low order subfields.

In case high-luminance display is realized, the number of data is thinned out in many subfields, the acquired time is allocated to the sustention period, however, in the case of high-definition display though the luminance is low, the image quality suitable for the contents of an image and the purpose of a user can be realized by reducing subfields in which data is thinned out or by not thinning data out.

High quality display where the deterioration of image quality is hardly striking can be realized by dividing an input picture signal into vertical frequency components, limiting display resolution information and reducing time for controlling a lighted picture element.

Further, in case subfields simultaneously addressed for two lines using the same data exist, a conversion error caused by the compression of the address control period can be dispersed substantially equally by equalizing the average value of two lines of a display signal to the average value of two lines of an input signal possibly and the deterioration of image quality can be reduced.

As described above, according to the invention, the address control period of a predetermined subfield is reduced and this time can be allocated to the improvement of image quality in luminance, gradation and a pseudo contour.

Even if the address control period is reduced, the deterioration of image quality can be reduced by addressing high order subfields including the most significant subfield every line as heretofore and simultaneously addressing a group of low order subfields having relatively small weight of emission for two lines using the same data.

In case subfields simultaneously addressed for two lines using the same data exist, a conversion error caused by the compression of the address control period can be substantially equally dispersed by equalizing the average value of two lines of display signal to the average value of two lines of an input signal possibly and the deterioration of image quality can be reduced.

What is claimed is:

1. A display, comprising, a picture element of a screen driven by plural subfields to light the picture element and display an image, wherein a first subfield simultaneously addresses plural lines and a second subfield independently addresses every line, wherein picture elements in a vertical direction of the plural lines simultaneously addressed in the first subfield are included in the same display information; and in the second subfield, if a difference between the display information and the display information of an original image is larger than a predetermined value, then an independent bit is added to the display information.

2. A display panel for displaying an image comprising:

a picture signal processing circuit that processes an input picture signal by conversion in a subfield including the least significant subfield, the weight of emission of which is the smallest and provided with a limiting circuit that limits the display resolution information of a subfield in which plural lines are simultaneously addressed, and an independent bit adding circuit that releases the limit of the display resolution information of a subfield in which each line is independently addressed; and a driving circuit that addresses and lights a picture element of the display panel based upon the output of the picture signal processing circuit, wherein the display panel is driven by the driving circuit in a state such that an address period in which a lighted picture element of the screen is selected is reduced in a subfield, the display resolution information of which is limited so that an image corresponding to the input picture signal is displayed, wherein the independent bit adding circuit adds an independent bit to the output of the limiting circuit in case difference between the output of the limiting circuit and the display resolution information of an original image is larger than a predetermined value.

3. A display according to claim 2, wherein:

the limiting circuit limits display resolution by selecting and synthesizing display resolution information divided into plural frequencies.

4. A display according to claim 3, wherein:

the limiting circuit multiplies the selected frequency component by an equal coefficient and adds or subtracts.

5. A display according to claim 2, wherein:

the limiting circuit and the independent bit adding circuit can control a subfield in which an address period is reduced and a subfield in which the limit of display resolution information is released according to setting from an external device.

6. A display according to claim 2, wherein:

the independent bit adding circuit converts a pair of lines when an address period is reduced in a subfield in which plural lines are simultaneously addressed so that the average value of two lines of an input signal and the average value of two lines of a display signal are substantially equal.

7. A display according to claim 2, wherein:

a subfield in which the limit of display resolution information is released is a subfield related to the gradation display of a fourth or fifth bit from the least significant bit when 256 gradations (8 bits) are normalized.

8. A display according to claim 2, wherein:

the independent bit adding circuit does not add an independent bit in case the difference is equal to or less than the predetermined value.

9. A display in a subfield mode in which an addressed picture element of a screen is lighted and an image is displayed, comprising:

a screen where the picture elements are arranged on plural lines;

a picture signal processing circuit that converts an input picture signal to subfield data showing lighting and unlighting in each subfield including the least significant subfield the weight of emission of which is the smallest and provided with a limiting circuit that limits the display vertical resolution information of a subfield in which plural lines are simultaneously addressed and an independent bit adding circuit that releases the limit of the display vertical resolution information of a subfield in which each line is independently addressed;

a control circuit that controls the address period of a subfield having bit data; and a driving circuit that addresses and lights a picture element of the screen based upon the output of the picture signal processing circuit and the control circuit, wherein:

an address period in a subfield in which plural lines of the screen are simultaneously addressed is controlled, a picture element having bit data is driven and an image is displayed, wherein the independent bit adding circuit adds an independent bit to the output of the limiting circuit in case difference between the output of the limiting circuit and the display vertical resolution information of an original image is larger than a predetermined value.

10. A display according to claim 9, wherein:

the limiting circuit limits display vertical resolution by selecting and synthesizing display vertical resolution information divided into plural frequencies.

11. A display according to claim 10, wherein:

the limiting circuit multiplies the selected frequency component by an equal coefficient and adds or subtracts.

12. A display according to claim 9, wherein:

the limiting circuit and the independent bit adding circuit can control a subfield in which an address period is reduced and a subfield in which the limit of display vertical resolution information is released according to setting from an external device.

13. A display according to claim 9, wherein:

the independent bit adding circuit converts a pair of lines when an address period is reduced in a subfield in which the plural lines are simultaneously addressed so that the average value of two lines of an input signal and the average value of two lines of a display signal are substantially equal.

14. A display according to claim 9, wherein:

a subfield in which the limit of display vertical resolution information is released is a subfield related to the gradation display of a fourth or fifth bit from the least significant bit when 256 gradations (8 bits) are normalized.

15. A display according to claim 9, wherein:

the limiting circuit processes referring to input signals to adjacent plural lines.

16. A display according to claim 9, wherein:

the limiting circuit processes referring to input signals to adjacent two lines.

17. A display according to claim 9, wherein:

the independent bit adding circuit does not add an independent bit when the difference is equal to or less than the predetermined value.

18. An image displaying method of dividing an addressed picture element of a screen into plural subfields, lighting the picture element and displaying an image, comprising:

a step for providing a first subfield in which plural lines are simultaneously addressed and a second subfield in which each line is independently addressed;

a step for including picture elements in a vertical direction of plural lines simultaneously addressed in the first subfield in the same display resolution information; and a step for adding an independent bit to display resolution information in the second subfield in case difference between the display resolution information and the resolution information of an original image is larger than a predetermined value.

19. A display apparatus for displaying an image by using a subfield comprising:

a display panel having a picture element that is lighted by the subfield to make an image;

a picture signal processing circuit to process an input picture signal by conversion in the subfield, the picture signal circuit including a limiting circuit and an independent bit adding circuit;

a driving circuit to address and light a picture element of the display panel based upon the output of the picture signal processing circuit, wherein the limiting circuit limits display resolution information of a subfield which includes a least significant subfield, the weight of emission of which is the smallest and which simultaneously addresses plural lines, wherein if a difference between an output of the limiting circuit and the display resolution information of an original image is larger than a predetermined value, then the independent bit adding circuit releases the limit of the display resolution information of a subfield in which plural lines are simultaneously addressed, wherein the display panel is driven by the driving circuit in a state such that an address period of a selected lighted picture is reduced in a subfield the display resolution information of which is limited and an image corresponding to the input picture signal is displayed.

* * * * *

UNITED STATES PATENT AND TRADEMARK OFFICE

CERTIFICATE OF CORRECTION

PATENT NO. : 6,774,874 B2
APPLICATION NO. : 09/930837
DATED : August 10, 2004
INVENTOR(S) : Kazutaka Naka and Masanori Takeuchi It is certified that error appears in the above-identified patent and that said Letters Patent is hereby corrected as shown below:

(73) Assignee: Hitachi, Ltd. and Fujitsu Hitachi Plasma Display Co., Ltd.

Signed and Sealed this

Twenty-fourth Day of October, 2006

JON W. DUDAS
*Director of the United States Patent and Trademark Office*